United States Patent [19]

Grob

[11] Patent Number: 4,526,147

[45] Date of Patent: Jul. 2, 1985

[54] APPARATUS FOR CONTROLLING THE AIR-FUEL RATIO OF AN INTERNAL COMBUSTION ENGINE

[75] Inventor: Ferdinand Grob, Besigheim, Fed. Rep. of Germany

[73] Assignee: Robert Bosch GmbH, Stuttgart, Fed. Rep. of Germany

[21] Appl. No.: 593,546

[22] Filed: Mar. 26, 1984

[30] Foreign Application Priority Data

Mar. 29, 1983 [DE] Fed. Rep. of Germany ..... 3311350

[51] Int. Cl.[3] ..... F02B 3/08

[52] U.S. Cl. ..... 123/440; 123/489; 123/492

[58] Field of Search ..... 123/440, 489, 492; 73/23

[56] References Cited

U.S. PATENT DOCUMENTS

| | | | |
|---|---|---|---|
| 4,393,841 | 7/1983 | Drews et al. | 123/440 |
| 4,445,482 | 5/1984 | Hasegawa et al. | 123/489 |
| 4,449,508 | 5/1984 | Glockler et al. | 123/440 |
| 4,450,812 | 5/1984 | Otsuka et al. | 123/440 |
| 4,454,846 | 6/1984 | Suzuki et al. | 123/440 |

*Primary Examiner*—Raymond A. Nelli
*Attorney, Agent, or Firm*—Walter Ottesen

[57] ABSTRACT

The invention is directed to an apparatus for controlling the air-fuel ratio, in particular of an internal combustion engine. The apparatus includes a sensor responsive to this ratio such as an oxygen sensor or the like and a circuit arrangement for evaluating the sensor output signal. The circuit arrangement includes means to compensate for the offset voltage influence thereby permitting a precise control of the air-fuel ratio in a Lambda range in which the dependent relationship between the sensor output and the sensor input signals is barely distinctive. For this purpose, the influence of the offset voltage of the control amplifiers used is measured at regular or irregular intervals and stored in analog or digital format. On the one hand, this stored quantity may be used to apply to the inputs of the control amplifiers a compensating voltage acting in opposition to the input offset voltage or, on the other hand, to subtract from the operational amplifier output the voltage portion resulting from offset voltages. The apparatus of the invention is also suitable for controlling the air-fuel ratio of heating equipment.

22 Claims, 6 Drawing Figures

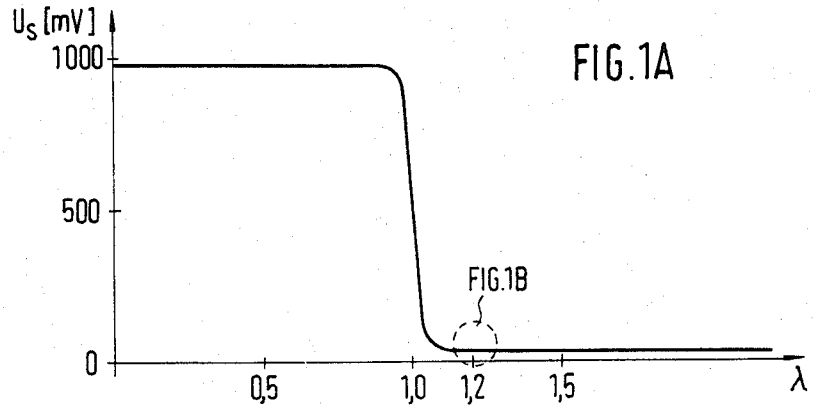
FIG.1A
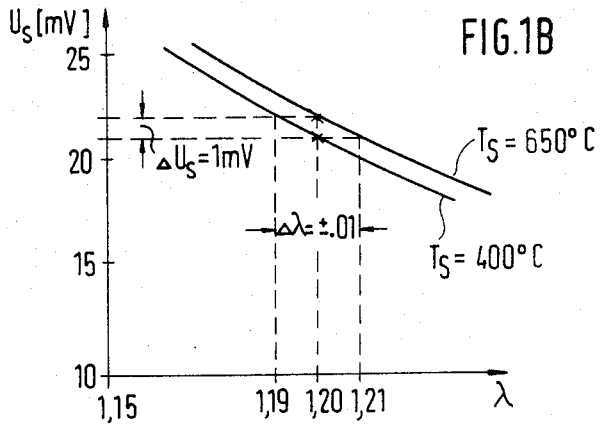
FIG.1B
FIG.2
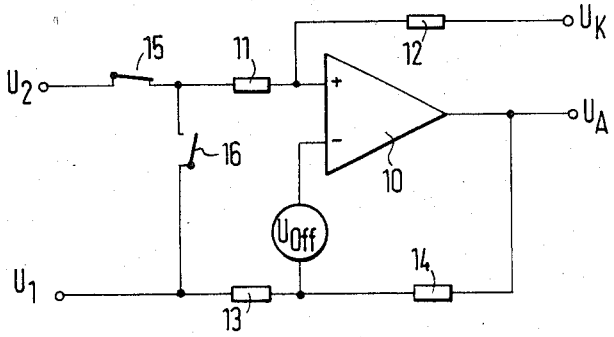

APPARATUS FOR CONTROLLING THE AIR-FUEL RATIO OF AN INTERNAL COMBUSTION ENGINE

FIELD OF THE INVENTION

This invention relates to an apparatus for controlling the air-fuel ratio of an internal combustion engine and includes a sensor responsive to this ratio, in particular an oxygen sensor (Lambda sensor), and a circuit arrangement for evaluating the sensor output signal.

BACKGROUND OF THE INVENTION

An apparatus of the aforementioned type is known, for example, from U.S. Pat. No. 3,738,341. In this application, a sensor continuously analyzes the exhaust gases of an internal combustion engine with respect to the air-fuel ratio, with this ratio being corrected in accordance with the result of the analysis by suitably regulating the supply of fuel or air. The sensor for analyzing the exhaust gas is responsive to the oxygen content of the exhaust gas and has its most effective operating range at temperatures of between 400° and 500° C.

Sensors of this type, which respond to the oxygen content of the exhaust gas (Lambda sensors) including the pattern of the sensor output voltage in dependence on Lambda, are disclosed, for example, in U.S. Pat. No. 4,345,562. The sensor includes a solid electrolyte, for example, zirconium dioxide, to which contacts are applied to both sides. If the oxygen proportions at the two surfaces of the solid electrolyte differ, a potential difference results at the contacts which changes abruptly at an air ratio of Lambda=1. This voltage change of the Lambda sensor occurring at Lambda values $\lambda=1$ is conventionally utilized for control purposes because the voltage change is relatively independent of other parameters such as temperature and can be reliably detected using threshold-value switches.

Further, methods and apparatus are known that serve to compensate for offset-voltage influences in operational amplifiers. The book "Circuits for Electronics Engineers", S. Weber, McGraw-Hill, Inc., New York 1977 describes on page 243 an arrangement including two operational amplifiers connected in series, in which the influences of the offset voltage and offset-voltage drifts compensate each other. However, this method promises to be successful only if the spread between the two operational amplifiers is neglected.

The above-described state-of-the-art control arrangement including an oxygen sensor to detect the air-fuel ratio operates satisfactorily as long as the change in the sensor output voltage at $\lambda=1$ is utilized for the control.

In various cases, it may however be advantageous with a view to achieving optimum exhaust emission and fuel consumption figures to adjust the air-fuel ratio in spark-ignition internal combustion engines to values in the range of $1.05 \leqq \lambda \leqq 1.4$. Using the known Lambda sensors, sensor output voltages in the range ($50\ \text{mV} \geqq U_s \geqq 10\ \text{mV}$) result for this range of Lambda values. Because of the very low gradient of the sensor characteristic in this Lambda value range, even minor drifts of the control amplifiers which further process the sensor output signal result in major errors in the determination of the actual Lambda value. Assuming, for example, the actual Lambda value to be $\lambda=1.20$, this corresponds to a sensor output voltage of approximately 20 mV. When comparing this sensor output voltage with the offset values of standard operational amplifiers as used in automotive electronics, such as: CA 3240 described in "RCA Linear Integrated Circuits" published 1978, SE 535 described in "Professionelle Integrierte Analogschaltungen 1981/1982" and LM 2902 and LM 224A described in "Linear Databook" of National Semiconductor Corporation, it will be seen that the total drift as the sum of the offset voltage and the offset voltage drift is between 2 mV and 10 mV in the temperature range of between −40° C. and +85° C., that is up to 50% of the signal utilized. It will be apparent that such an arrangement will produce only unsatisfactory results regarding exhaust emission and fuel consumption figures. The use of high precision measuring amplifiers such as chopper amplifiers, in addition to involving high cost, is impaired by insufficient rigidity in the rough environment associated with motor vehicles and incompatibility regarding the supply voltages (mostly bipolar).

SUMMARY OF THE INVENTION

In contrast, the apparatus for controlling, in particular, the air-fuel ratio of an internal combustion engine as disclosed in this invention utilizes simple and low-cost circuits to achieve a high precision detection and evaluation of the sensor output voltage and a very accurate determination of the actual Lambda value. Moreover, it is advantageous that the operational amplifier which senses the sensor output voltage is configured as a subtracting amplifier. In this way, the error caused by potential differences between the ground connections of the Lambda sensor and the evaluation circuit, which may amount to several millivolts, is suppressed.

BRIEF DESCRIPTION OF THE DRAWING

The invention will now be described with reference to the drawing wherein:

FIG. 1A is a diagram showing the output signal of an oxygen sensor plotted against Lambda ($\lambda$);

FIG. 1B is a portion, on an enlarged scale, of the sensor characteristic for Lambda values in the neighborhood of $\lambda=1.20$, showing also the sensor characteristic with changes in the temperature $T_s$ of the oxygen sensor as parameter;

FIG. 2 is a circuit diagram of an operational amplifier configured as a subtracting amplifier to show the influence of the offset voltage;

DESCRIPTION OF THE PREFERRED EMBODIMENTS OF THE INVENTION

Figure 3:
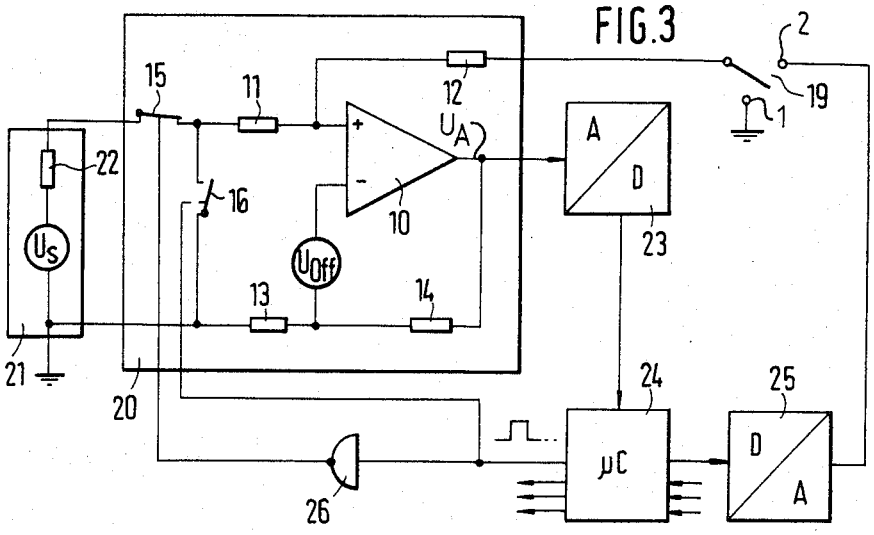
FIG. 3 is a first embodiment of the control apparatus according to the invention.

FIG. 1A is a plot of the output signal of an oxygen sensor against Lambda ($\lambda$). In the presence of Lambda values $\lambda<1.0$, the output voltage is high, being in the range of 1,000 mV. At $\lambda=1$, the sensor voltage drops sharply, resulting in sensor output voltages of $U_s<50$ mV for Lambda values $\lambda>1.0$. Known control apparatus utilize the potential drop occurring at $\lambda=1$ for controlling the air-fuel ratio. For this purpose, for example, a threshold value is set at about 500 mV and regulated to the value $\lambda=1$ by two-position control.

The relationships change considerably if for a lean-mixture control, the air-fuel ratio is adjusted to $\lambda=1.20$, for example. FIG. 1B which shows an enlarged portion of FIG. 1A shows that $\lambda=1.20$ is associated with a sensor output voltage of about 21 mV. The gradient of the sensor characteristic is so low in this range that an error in the determination of the sensor output voltage $\Delta U_s=1$ mV causes Lambda to be inaccurate by $\Delta\lambda=0.01$. Further, FIG. 1B shows the dependence of the sensor characteristic upon temperature. A change in the operating temperature $T_s$ of the heated sensor which occurs under changing load conditions as a result of different exhaust-gas temperatures in the range from $T_S=400°$ C. to $T_S=650°$ C. has the same effect regarding the error in the determination of Lambda as an error in the determination of the sensor output of 1 mV. If the temperature-induced drifts of the sensor characteristic are not compensated for and if the electronic circuit arrangement is not to cause a material increase in the total error, then it is necessary to compensate the input offset voltage to values below 0.1 mV, approximately.

FIG. 2 clarifies the quantities used in the description of the preferred embodiments of the invention that follows. Reference numeral 10 identifies an operational amplifier having applied to its positive input a voltage $U_2$ via a resistor 11 as well as a compensating voltage $U_K$ via a resistor 12. The negative input of the operational amplifier 10 is connected to the input voltage $U_1$ via a resistor 13, with a voltage source $U_{Off}$ which is symbolically illustrated to represent all offset-voltage influences being inserted between the resistor 13 and the negative input. From the junction between this voltage source $U_{Off}$ and the resistor 13, a line branches off to a feedback resistor 14, connecting with the output of operational amplifier 10 at which the output voltage $U_A$ is to be taken off. A switch 15 permits the connection between the voltage source $U_2$ and the resistor 11 to be interrupted; whereas, a complementary-actuated switch 16 also permits the input voltage $U_1$ to be applied to the positive input.

Using the quantities $V=R_{14}/R_{13}$ and $V'=R_{12}/R_{11}$, the output voltage $U_A$ of the circuit arrangement results as follows:

$$U_A=U_2(1+V)(V')/(1+V')-(U_1)(V)-+(U_K)(1+V)/(1+V')-U_{Off}(1+V)$$

In the ideal case, that is, when the offset voltage $U_{Off}$ and the compensating voltage $U_K$ are equal to zero and the resistance ratio is $V=V'$, this equation is reduced to:

$$U_A=V(U_2-U_1)$$

This means that the output voltage assumes values proportional to the input-voltage difference, multiplied by the proportionality factor which is determined by the resistance ratio V. When the condition $U_{Off}=0$ is dropped, the output voltage obtained for the ideal operational amplifier results only if a compensating voltage $U_K$ given by:

$$U_K=U_{Off}(1+V)$$

is applied to the positive input of operational amplifier 10 via resistor 12.

By suitable actuation of switches 15 and 16, it is possible to determine the value of the compensating voltage $U_K$. During the normal measuring operation, compensation cycles of short duration are periodically introduced, for example, by opening switch 15 for 1 ms while keeping the complementary-actuated switch 16 closed for the same period of time. For this period, the input-voltage difference is $U_2-U_1=0$ so that a control arrangement still to be described enables the compensating voltage $U_K$ to be changed in a manner causing also the output voltage $U_A$ to assume zero value. This value of the compensating voltage $U_K$ is stored in hold elements in an analog or digital manner until the next compensation cycle. This value $U_K$ generally assumes the value $$U_K+U_{Off}(1+V')-U_1(V'-V)/(1+V),$$

if the requirement for equal resistance ratios V, V' is dropped.

The output voltage of the compensated amplifier becomes:

$$U_A=(U_2-U_1)(1+V)(V')/(1+V')$$

so that after compensating, the influence of the offset voltage is eliminated. In the presence of resistance ratios V, V' which are not precisely identical, the value of the output voltage deviates from the ideal value only very slightly so that the resulting inaccuracy is negligible for the control action. For example, if a resistance ratio V, V' of 100 is aimed at and, if the resistors R12, R11 used have a tolerance of $\pm 2\%$, the deviation from the ideal value is less than one per mil.

The embodiment of FIG. 3 serves on the one hand to illustrate the described compensation method in a digital configuration and, on the other hand, to explain another method for suppression of the influence of the offset voltages. Considering that the two compensation methods differ little in terms of their circuit configuration requirements, a switch 19 was introduced in FIG. 3 which permits selection of the desired compensation method.

Reference numeral 20 identifies the subtracter stage already described with reference to FIG. 2, with like components having like reference numerals. The oxygen sensor is designated by reference numeral 21 and is depicted in the form of an equivalent circuit which includes a voltage source $U_S$ and an internal resistor 22 connected in series therewith. The output voltage of the sensor 21 is applied to the subtracter stage 20 as an input-voltage difference $(U_2-U_1)$. In the present case, the oxygen sensor has one end connected to ground so that $U_1=0$. The subtracter stage output voltage $U_A$ is applied via an analog-to-digital converter 25 which, in the event that switch 19 is in switch position 2, has its output connected to resistor 12.

On the other hand, the microcomputer 24 generates the clock frequency to actuate switches 15 and 16, with switch 15 being driven via an inverter 26 so that a complementary switching action results for the two switches. The microcomputer 24 outputs indicated by arrows are applied to positioning devices and other arrangements for further signal processing. These output quantities may be corrected by other parameters that characterize the condition of the internal combustion engine, such as temperature, power output or pressure.

For implementation of the second compensation method, the connection between the digital-to-analog converter 25 and the resistor 12 is interrupted by switch 19. In this mode, the resistor 12 is connected to ground with the switch 19 in position 1.

Assuming switch 19 is in switch position 2, the arrangement of FIG. 3 operates as described below.

In the normal control mode in which switch 15 is closed and switch 16 is open, the output voltage of operational amplifier 10 is digitalized, supplied to the microcomputer 24, corrected in dependence on other operating parameters, further processed and fed to the positioning devices. For the compensation mode, the microcomputer actuates switches 15 and 16 so that the input voltage of the operational amplifier 10 assumes zero value. The output voltage $U_A$ which then remains at the output of operational amplifier 10 is solely attributable to the influence of the offset voltage. This voltage $U_A$ is transformed in the microcomputer 24 in accordance with the derived interrelationships and, via the digital-to-analog converter 25, supplied to resistor 12 as a compensating voltage $U_K$. Following reopening of switch 16 and reclosing of switch 15, this voltage value $U_K$ remains stored in microcomputer 24 until the next compensation cycle. Because of the unlimited storage time of digital storage, it is not necessary to repeat the compensating procedure too often or periodically. Thus it is possible, for example, to perform the compensation during such periods of time in which a Lambda control or Lambda lean-mixture control is not necessary or possible, which is the case during the time that the sensor heats up or under full-load or overrunning conditions of the internal combustion engine.

To implement the second compensation method, resistor 12 is connected to a constant potential, the ground potential, with the digital-to-analog converter 25 omitted (switch 19 in position 1). For the compensation mode, switches 15 and 16 are appropriately actuated as in the first method so that the voltage present at the output of operational amplifier 10 is solely attributable to offset influences. In contrast to the first method, however, the input offset voltage is not compensated for by a compensating voltage acting in the opposite direction; instead, the output offset voltage is converted into digital representation in the analog-to-digital converter 23, stored in the microcomputer 24 and subtracted from the individual output voltage values after completion of the compensation cycle and another actuation of switches 15 and 16. In this method too, the compensation procedure may be repeated periodically or it may be performed during periods of time in which no Lambda control is necessary or possible. Thus, this method is based on the fact not to compensate for the input offset voltage per se but to measure its influence at the amplifier output and to deduct this value from the output quantity occurring in the normal control mode.

Figure 4:
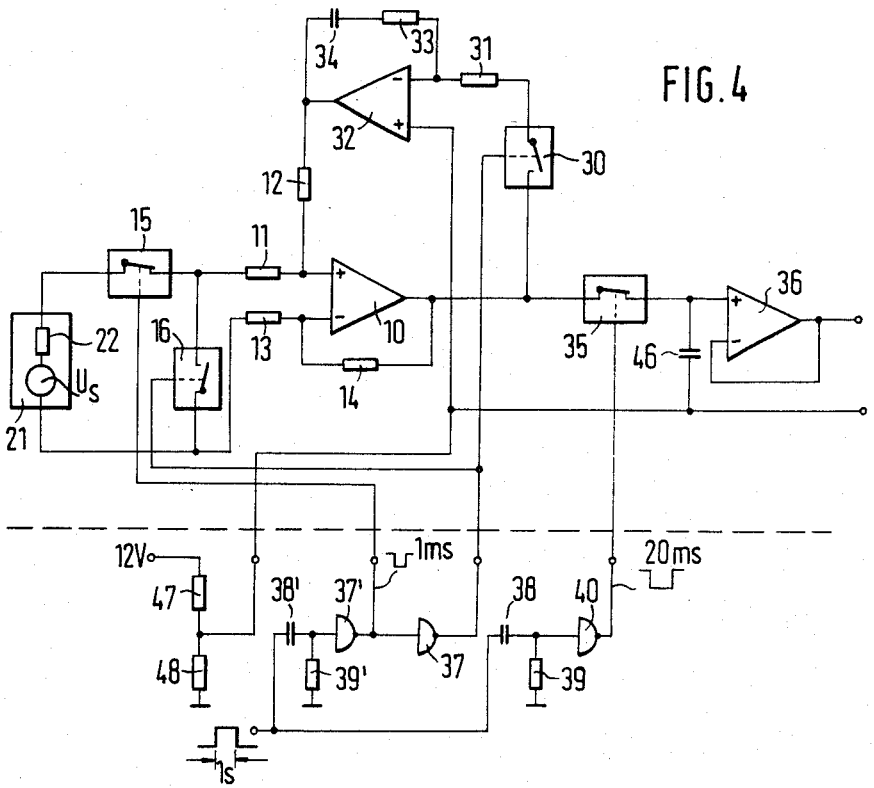
FIG. 4 is a second embodiment of the control apparatus according to the invention; and, FIG. 5 is a family of curves showing the experimentally determined temperature pattern of the input offset voltage of the apparatus according to the invention, with the input voltage as parameter.

FIG. 4 illustrates an analog embodiment for storage and compensation of the input offset voltage. The output voltage of operational amplifier 10 which has the same circuit configuration as block 20 of FIG. 3 is applied via a switch 30, which is activated by the same signals as switch 16, to a resistor 31 connected to the negative input of an operational amplifier 32. Via a resistor 33 and a capacitor 34 connected in series therewith, the negative input of operational amplifier 32 is connected to the output thereof and to resistor 12. Further, the output signals of operational amplifier 10 are fed via a switch 35 to an operational amplifier 36 configured as a voltage follower whose output signal, related to a reference voltage value, represents an accurate measure of the sensor output voltage. This reference voltage value is predetermined by the voltage divider ratio of the voltage divider made up of resistors 47 and 48. Operational amplifier 36 has its positive input connected to the reference voltage via a capacitor 46. This reference voltage, which is derived from the vehicle voltage, is also applied to the positive input of operational amplifier 32. The change from control mode to compensation mode is effected by switches 15, 16, 30, 35 which are activated by a voltage pulse having a duration of about 1 s. Via a differentiator comprised of resistor 39' and capacitor 38' and via an inverter 37', this pulse causes the switch 15 to be in the open position for about 1 ms and goes via an inverter 37 to switches 16 and 30, causing these to be closed for the same length of time. Via another differentiator made up of capacitor 38 and resistor 39, the 1 sec pulse is reduced to about 20 ms, inverted in an inverter 40 and supplied to switch 35 so that this switch opens simultaneously with switch 15 and yet closes only after a period of about 20 ms has elapsed which is determined by the time constant of the high pass.

For compensation of the input quiescent current, switch 15 is opened while at the same time switches 16 and 30 are closed. The output voltage of operational amplifier 10 which is now exclusively dependent on the input offset voltage goes via the closed switch 30 to the negative input of operational amplifier 32 configured as a PI controller. As a result of the feedback of the output of this operational amplifier 32 via resistor 12 to the positive input of operational amplifier 10, the output voltage of operational amplifier 32 is adjusted such that the voltage at the output of operational amplifier 10 assumes zero value, resulting in compensation of the arrangement.

Following opening of switch 30, the charge in capacitor 34, which corresponds to this compensating voltage at the output of operational amplifier 32, remains stored for a period of time predetermined by the very high input resistance of the FET operational amplifier 32 and the capacitance of capacitor 34. In this analog version of the storage arrangement, this discharge of capacitor 34 via the input of operational amplifier 32, although it is only minor, makes it necessary to conduct the compensation more frequently. The switch 35 is closed with a delay of about 20 ms to bridge the response time of the circuit arrangement caused by input filters not shown.

During this time it is advantageous to use the last measured Lambda value as the actual Lambda value. This is accomplished by capacitor 46 at the positive input of operational amplifier 36 which stores during each compensation cycle the last actual value of the output voltage of operational amplifier 10. Immediately following termination of a compensation cycle, the capacitor 46 is recharged to reflect the new value. The output voltage of the impedance transformer 36 is passed on to further control units for additional processing.

Figure 5:
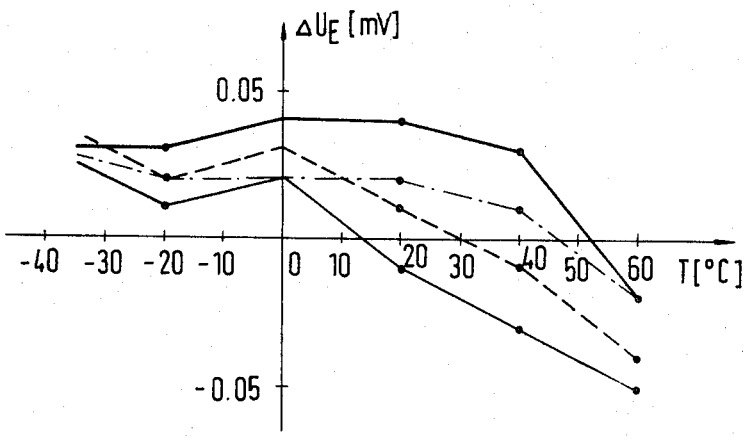

FIG. 5 shows the experimentally determined temperature pattern of the input offset voltage of an embodiment of the invention corresponding to FIG. 4, with the input voltage $U_E$ in the range between 10 mV and 40 mV as a parameter. Irrespective of their individual patterns, all curves have in common that the input offset voltage varies by less than $\pm\lambda 50$ V over a temperature range of about 100° C. These measurement curves confirm clearly the capability of the arrangement of the invention, wherein the actual Lambda value can be determined with a high degree of accuracy, even for lean-mixture controls at extreme Lambda values up to $\lambda \sim 1.80$. Such lean-mixture controls of the combustion process in the range of $\lambda > 1.50$ gain particular importance in heating equipment such as water heaters for example. Heating equipment of this type is described, for example, in German published patent applications DE-OS No. 3,037,935 and DE-OS No. 3,037,936.

It is understood that the foregoing description is that of the preferred embodiments of the invention and that various changes and modifications may be made thereto without departing from the spirit and scope of the invention as defined in the appended claims.

What is claimed is:

1. Apparatus for controlling the air-fuel ratio of an internal combustion engine comprising:

a lambda probe responsive to changes in said ratio and monitoring said ratio over a range of lambda values that includes a region wherein the output voltages of the probe exhibit only a weak dependence upon inputs to the probe; and, a circuit arrangement for evaluating the output of said probe and including: an operational amplifier wherein an offset voltage occurs because of drift in said circuit arrangement and temperature variations to which said probe is subjected during operation thereof; and, compensation means for compensating for said offset voltage thereby permitting a precise regulation of the air-fuel ratio in said region, said compensation means including circuit means for compensating for said offset voltage of said operational amplifier, said circuit means including switching means for switching said operational amplifier from the operation mode into and out of a compensation mode in a sequence corresponding to segments of time when it is not necessary or possible to conduct a determination of the lambda value.

2. The apparatus of claim 1, said switching means including means for setting the input voltage of said operational amplifier to zero whereby the output voltage of said amplifier is said offset voltage and for switching said operational amplifier back into said operation mode; and, said circuit means including: storage means for receiving and storing said offset voltage during said compensation mode and for subtracting said stored offset voltage from the voltage at the output of said operational amplifier after said switching means switches said amplifier back into said operation mode.

3. The apparatus of claim 2, said storage means including means for storing said processed voltage for an inlimited time; and, said circuit means including means for switching said operational amplifier into and out of said compensation mode at a preselected repetition frequency.

4. The apparatus of claim 2 said storage means including means for storing said processed voltage for an unlimited time; and, said circuit means including means for switching said operational amplifier into and out of said compensation mode in a sequence to correspond to segments of time when it is not necessary or possible to conduct a determination of the lambda value.

5. The apparatus of claim 2, said means for storing said processed voltage being analog means.

6. The apparatus of claim 2, said processing circuit means comprising: an analog-to-digital convertor for converting said output voltage into a digital quantity; a microcomputer for processing said digital quantity, said storage means being part of said microcomputer for storing said digital quantity; and, a digital-to-analog convertor for converting said digital quantity back to an analog quantity.

7. The apparatus of claim 2, said operational amplifier being a subtracting operational amplifier connected to said lambda probe for receiving the output thereof.

8. The apparatus of claim 2, said processing circuit means being configured so as to permit both lean and rich air-fuel ratios to be controlled in the region of $\lambda \sim 1.2$ and of $\lambda \sim 0.8$, respectively, with a relative accuracy lying in the range of one part per mil.

9. The apparatus of claim 8, said processing circuit means being further configured to provide a continuous control of the air-fuel ratio.

10. Apparatus for controlling the air-fuel ratio of an internal combustion engine comprising:

a lambda probe responsive to changes in said ratio and monitoring said ratio over range of lambda values that includes a region wherein the output voltages of the probe exhibit only a weak dependence upon inputs to the probe; and, a circuit arrangement for evaluating the output of said probe and including an operational amplifier wherein an offset voltage occurs because of drift in said circuit arrangement and temperature variations to which said probe is subjected during operation thereof; and, compensation means for compensating for said offset voltage thereby permitting a precise regulation of the air-fuel ratio in said region, said compensation means including circuit means for compensating for the influence of said offset voltage of said operational amplifier;

said circuit means including:

switching means for switching said operational amplifier from the operation mode into a compensation mode by setting the input voltage of said amplifier to zero whereby the output voltage of said operational amplifier is caused exclusively by said offset voltage and for switching said operational amplifier back into said operation mode;

processing circuit means for processing said output voltage and applying the processed output voltage to the input of said operational amplifier whereby the output of said amplifier is reduced to zero; and, storage means for storing said processed output voltage until the operational amplifier is again switched into the compensation mode.

11. The apparatus of claim 10, said storage means including means for storing said processed voltage for an unlimited time; and, said circuit means including means for switching said operational amplifier into and out of said compensation mode at a preselected repetition frequency.

12. The apparatus of claim 10, said storage means including means for storing said processed voltage for an unlimited time; and, said circuit means including means for switching said operational amplifier into and out of said compensation mode in a sequence to correspond to segments of time when it is not necessary or possible to conduct a determination of the lambda value.

13. The apparatus of claim 10, said means for storing said processed voltage being analog means.

14. The apparatus of claim 10, said processing circuit means comprising: an analog-to-digital convertor for converting said output voltage into a digital quantity; a microcomputer for processing said digital quantity, said storage means being part of said microcomputer for storing said digital quantity; and, a digital-to-analog convertor for converting said digital quantity back to an analog quantity.

15. The apparatus of claim 10, said operational amplifier being a subtracting operational amplifier connected to said lambda probe for receiving the output thereof.

16. The apparatus of claim 10, said processing circuit means being configured so as to permit both lean and rich air-fuel ratios to be controlled in the region of $\lambda \sim 1.2$ and of $\lambda \sim 0.8$, respectively, with a relative accuracy lying in the range of one part per mil.

17. The apparatus of claim 16, said processing circuit means being further configured to provide a continuous control of the air-fuel ratio.

18. Apparatus for controlling the air-fuel ratio of heating equipment comprising:

a lambda probe responsive to changes in said ratio and monitoring said ratio over a range of lambda values that includes a region wherein the output voltages of the probe exhibit only a weak dependence upon inputs to the probe; and, a circuit arrangement for evaluating the output of said probe and including an operational amplifier wherein an offset voltage occurs because of drift in said circuit arrangement and temperature variations to which said probe is subjected during operation thereof; and, compensation means for compensating for said offset voltage thereby permitting a precise regulation of the air-fuel ratio in said region, said compensation means including circuit means for compensating for said offset voltage of said operational amplifier, said circuit means including switching means for switching said operational amplifier from the operation mode into and out of a compensation mode in a sequence corresponding to segments of time when it is not necessary or possible to conduct a determination of the lambda value.

19. The apparatus of claim 18, said switching means including means for setting the input voltage of said operational amplifier to zero whereby the output voltage of said amplifier is said offset voltage and for switching said operational amplifier back into said operation mode; and, said circuit means including: storage means for receiving and storing said offset voltage during said compensation mode and for subtracting said stored offset voltage from the voltage at the output of said operational amplifier after said switching means switches said amplifier back into said operation mode.

20. Apparatus for controlling the air-fuel ratio of heating equipment comprising:

a lambda probe responsive to changes in said ratio and monitoring said ratio over a range of lambda values that includes a region wherein the output voltages of the probe exhibit only a weak dependence upon inputs to the probe; and, a circuit arrangement for evaluating the output of said probe and including an operational amplifier wherein an offset voltage occurs because of drift in said circuit arrangement and temperature variations to which said probe is subjected during operation thereof; and, compensation means for compensating for said offset voltage thereby permitting a precise regulation of the air-fuel ratio in said region, said compensation means including circuit means for compensating for the influence of said offset voltage of said operational amplifier;

said circuit means including:

switching means for switching said operational amplifier from the operation mode into a compensation mode by setting the input voltage of said amplifier to zero whereby the output voltage of said operational amplifier is caused exclusively by said offset voltage and for switching said operational amplifier back into said operational mode;

processing circuit means for processing said output voltage and applying the processed output voltage to the input of said operational amplifier whereby the output of said amplifier is reduced to zero; and, storage means for storing said processed output voltage until the operational amplifier is again switched into the compensation mode.

21. The apparatus of claim 20 comprising means for controlling an extremely lean air-fuel ratio of up to lambda having a value of 1.8.

22. The apparatus of claim 19 comprising means for controlling an extremely lean air-fuel ratio of up to lambda having a value of 1.8.

* * * * *

UNITED STATES PATENT AND TRADEMARK OFFICE

CERTIFICATE OF CORRECTION

PATENT NO. : 4,526,147

DATED : July 2, 1985

INVENTOR(S) : Ferdinand Grob

It is certified that error appears in the above-identified patent and that said Letters Patent is hereby corrected as shown below:

In column 4, line 13, delete "$U_K$+" and substitute -- $U_K$= -- therefor.

In column 6, line 64, delete "λ50" and substitute -- μ50 -- therefor.

In column 10, line 33, delete "operational" and substitute -- operation -- therefor.

Signed and Sealed this

*Twentieth* Day of *May 1986*

[SEAL]

*Attest:*

DONALD J. QUIGG

*Attesting Officer*

*Commissioner of Patents and Trademarks*